US005513744A

United States Patent [19]

Yabarra

[11] Patent Number: 5,513,744

[45] Date of Patent: May 7, 1996

[54] PROTECTIVE CASE FOR EYEGLASSES

[76] Inventor: Larry C. Yabarra, 4674 E. Vassar, Fresno, Calif. 93703

[21] Appl. No.: 347,812

[22] Filed: Nov. 30, 1994

[51] Int. Cl.[6] ..... A45C 11/04

[52] U.S. Cl. ..... 206/5; 206/6; 248/902

[58] Field of Search ..... 206/5, 6; 351/155, 351/158; 248/902

[56] References Cited

U.S. PATENT DOCUMENTS

| | | | |
|---|---|---|---|
| D. 173,295 | 10/1954 | Wantz . | |
| D. 333,037 | 2/1993 | Dweck . | |
| 2,479,472 | 8/1949 | Coplon | 206/5 |
| 2,623,722 | 12/1952 | Glunt et al. . | |
| 2,991,967 | 7/1961 | Bothos . | |
| 3,050,181 | 8/1962 | Nathan | 206/5 |
| 3,101,843 | 8/1963 | Thompson | 206/5 |
| 3,508,643 | 4/1970 | Horn . | |
| 4,634,004 | 1/1987 | Mortensen . | |
| 4,707,088 | 11/1987 | Tabacchi . | |
| 4,733,775 | 3/1988 | Fireman | 206/5 |
| 5,032,019 | 7/1991 | Burchett | 206/5 |

FOREIGN PATENT DOCUMENTS

| | | | |
|---|---|---|---|
| 3240 | of 1913 | United Kingdom | 206/5 |
| 500827 | 2/1939 | United Kingdom | 206/5 |

*Primary Examiner*—David T. Fidei
*Attorney, Agent, or Firm*—Mark D. Miller

[57] ABSTRACT

A specially designed eyeglass protector is provided that slides into an eyeglass case. The protector is made of sturdy crush-proof material, and includes openings which receive the temples and nose pads of the eyeglasses. The front of the frame and the eyeglass lenses fit into a recessed area that is surrounded by a protective lip. A small and convenient case in the form of an elongated closable pocket is also provided for receiving the protector holding the eyeglasses. Insertion into the tight-fitting case keeps the eyeglasses in the protector, and in addition to preventing crushing, provides a barrier to scratching and abrasion of the frames and lenses.

12 Claims, 2 Drawing Sheets

PROTECTIVE CASE FOR EYEGLASSES

BACKGROUND OF THE INVENTION

The present invention relates to eyeglasses, and more particularly to a new and improved protective shield for eyeglasses that is insertable into an ordinary eyeglass case.

Eyeglasses and eyeglass cases have existed in many forms for many years. A recurring problem for ordinary eyeglass users is the potential for accidental damage to the frames and/or lenses of the eyeglasses. If the eyeglasses are removed and placed in an open location, they may be accidentally dropped, crushed or scratched.

Common eyeglass cases do little to solve these problems. Rigid eyeglass cases, such as that disclosed in U.S. Pat. No. D-333,037, are inherently so bulky and cumbersome to use that they are generally more trouble than they are worth. They often work as a disincentive to use.

A number of eyeglass holders have been introduced over the years including a door-mountable version disclosed in U.S. Pat. No. 2,623,722, a table-top eyeglass holder block disclosed in U.S. Pat. No. 2,991,967 and an L-shaped eyeglass holder disclosed in U.S. Pat. No. D-173,295. All of these holders suffer from similar drawbacks. Each of these holders leaves the eyeglasses exposed to the dangers of inadvertent bumping, dropping or crushing. Each of these holders is also likely to scratch the frame or lens of the eyeglasses, or allow them to be easily scratched. None of the holders is easily portable.

SUMMARY OF THE INVENTION

The present invention overcomes all of these drawbacks by providing a specially designed eyeglass protector that slides into an eyeglass case. The protector includes two openings which receive the temples of the eyeglasses, and another central opening to receive the bridge and nose pads of the eyeglasses. A recessed area is provided which receives the front of the frame and the lenses of the eyeglasses. This recessed area is surrounded by a deep lip. The protector is made of sturdy material to resist crushing or breaking under heavy loads. A small eyeglass case in the form of an elongated closable pocket is also provided which receives the protector holding the eyeglasses. Insertion into the tight-fitting case keeps the eyeglasses in the protector, and provides a barrier to scratching and abrasion of the frames and lenses.

It is therefore a primary object of the present invention to provide a small, convenient, reliable and portable protector for eyeglasses.

It is a further important object of the present invention to provide a small, portable and convenient device for protecting eyeglasses from being crushed or scratched.

It is a further important object of the present invention to provide an eyeglass protector device that is designed to receive and hold a pair of eyeglasses to prevent them from being crushed.

It is a further important object of the present invention to provide an eyeglass protector device for holding a pair of eyeglasses that may be inserted with the eyeglasses into a small flexible carrying case to prevent the eyeglasses from being crushed or scratched.

It is a further important object of the present invention to provide a small protector for receiving a pair of eyeglasses which may then be inserted into a small, portable carrying case to prevent the frames and lenses of the eyeglasses from being crushed or scratched.

Additional objects will become apparent from the detailed description and the claims herein.

DETAILED DESCRIPTION OF THE DRAWINGS

Figure 1:
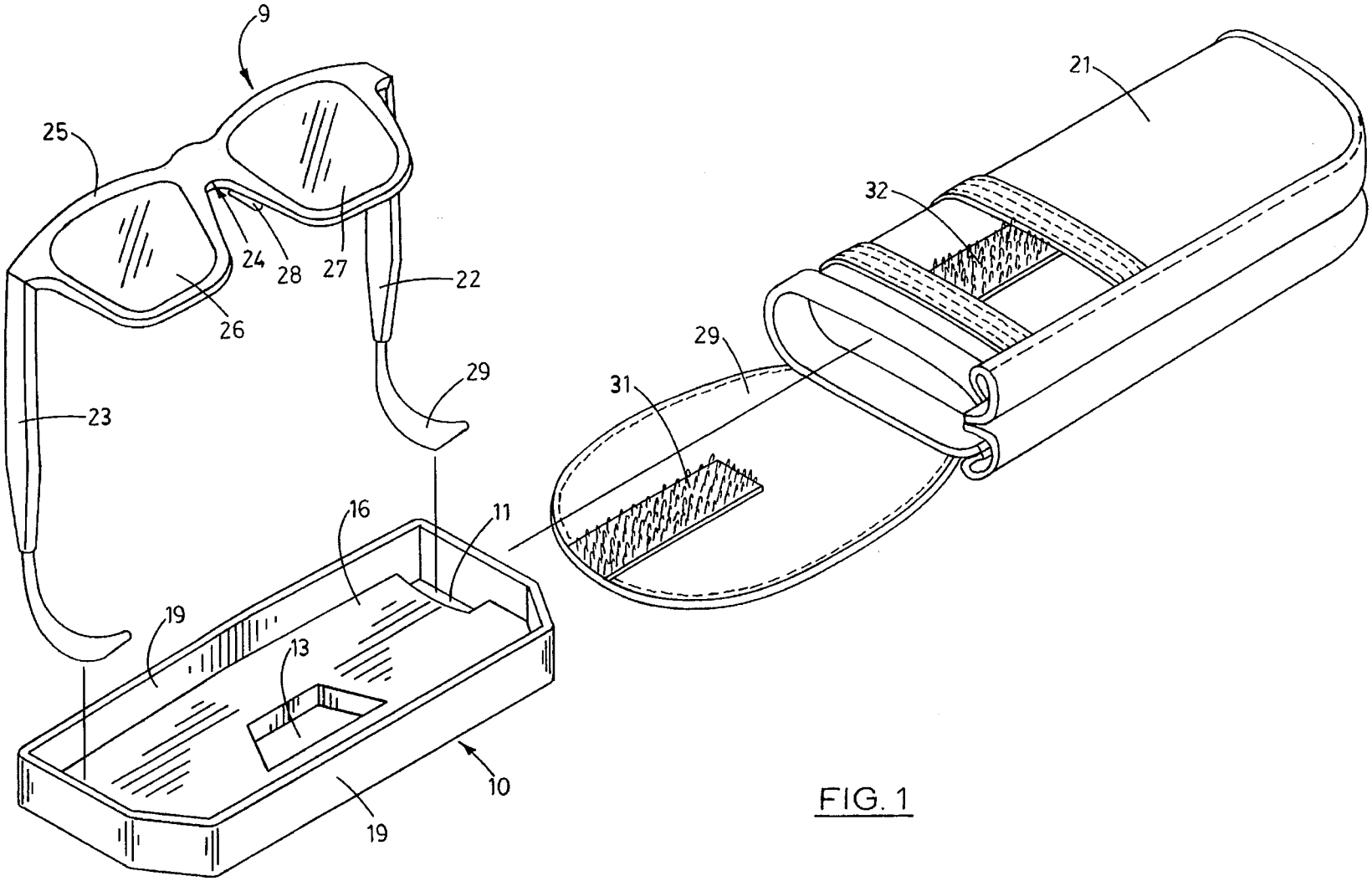
FIG. 1 is a perspective view of the present invention showing a pair of eyeglasses, the holder, and the closable carrying case.
Figure 2:
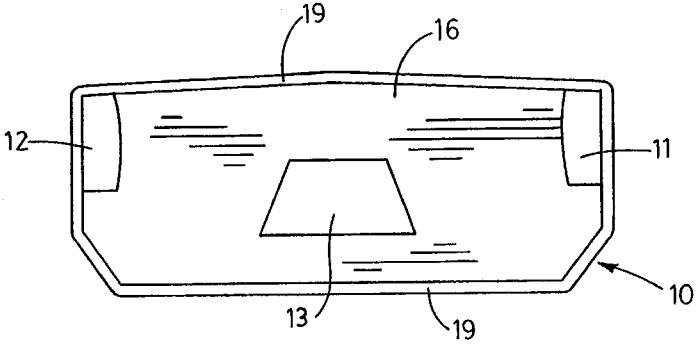
FIG. 2 is a front view of the eyeglass holder of the present invention.
Figure 3:
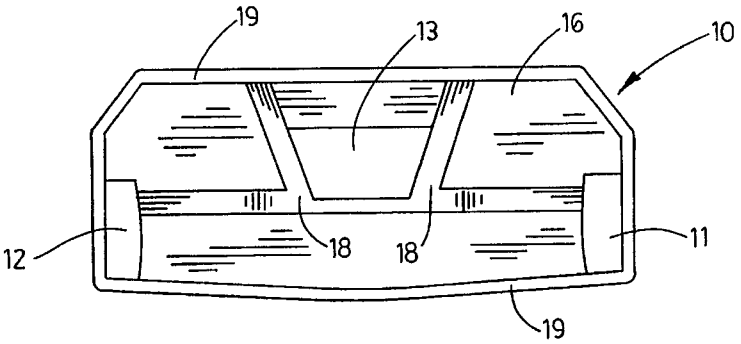
FIG. 3 is a back view of the eyeglass holder of the present invention.

Referring to the drawings wherein like reference characters designate like or corresponding parts throughout the several views, and referring particularly to FIGS. 1, 2 and 3, it is seen that the invention includes a holder, generally 10, having a flat base panel 16 surrounded by a lip 19 on one side. Base 16 has three openings in it. Openings 11 and 12 are in the upper right and left corners of base panel 16 and are inside lip 19. Openings 11 and 12 are designed to receive the left and right temples 22, 23 of the eyeglasses 9. Central opening 13 is in a trapezoidal shape and is designed to receive the bridge 24 and tabs/nose pads 28 of the eyeglasses to avoid damage to them.

After inserting temples 22, 23 through openings 11 and 12, the temples are closed on their hinges in the back of holder 10. The front frame 25 and lenses 26, 27 come to rest in the front of holder 10, and are surrounded by lip 19. A set of reinforcing members 18 are provided on the back of holder 10 to give added strength to avoid crushing.

Figure 4:
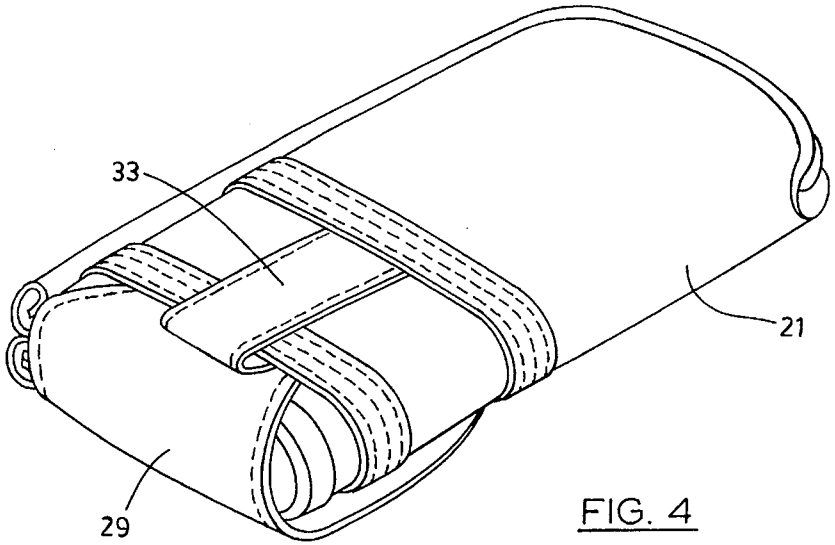
FIG. 4 is a perspective view of the closed carrying case into which the eyeglasses and holder have been inserted.

Once the eyeglasses 9 have been inserted into the holder 10 with the temples folded in the back, the combination of eyeglasses and holder is then inserted into flexible carrying case 21. The carrying case may have an optional closing means 31, 32 such as interengaging hooks and loops (as shown in FIG. 1), a fold over flap 29 (as shown in FIG. 4), or a snap, button, or the like. Case 21 may also have an optional carrying strap or belt loop hook 33.

DESCRIPTION OF THE PREFERRED EMBODIMENTS

In the preferred embodiment, holder 10 of the present invention is made of a rigid and sturdy material such as plastic or wood. Openings 11 and 12 should be wide enough to receive any of a variety of eyeglass temples, and should be long enough to accept many varieties of end pieces 29 on the temples. Opening 13 should be large enough to receive the tabs (nose pads) 28 located on the inside of the front frame 25 without bending or moving them. The back of the holder 10 should provide sufficient space to receive the folded temples 22, 23 of the eyeglasses 9. Although base panel 16 itself should be made of sturdy material, extra reinforcements 18 on the back are preferred to help the holder avoid being crushed under heavy loads.

The carrying case 21 should be small and convenient in size, but large enough to receive holder 10 with glasses 9 in place. Case 21 should be made of a durable flexible material such as leather, vinyl or the like which will not scratch or mar the frames or lenses. Although not necessary to the operation of the device, in the preferred embodiment case 21 has a closable flap 29 to help keep the holder and glasses inside.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An eyeglass holder comprising a sturdy two-sided flat panel having three openings therein, two of said openings being located at opposite ends of said panel for receiving the two temples of a pair of eyeglasses, and the remaining opening being located near the center of said panel for receiving the bridge and nose clips of a pair of eyeglasses, said panel having a raised lip around the perimeter of both sides, and reinforcing members are provided between said openings on one side.

2. The holder described in claim 1 above wherein a small case in the form of an elongated closable pocket is provided for snugly receiving said holder.

3. The holder described in claim 2 above wherein said holder is made of a crush proof material and said case is made of a durable flexible material.

4. The holder described in claim 2 above wherein the panel is made of wood and the case is made of leather.

5. The holder described in claim 2 above wherein said case includes a closable flap.

6. An eyeglass protector comprising:

a. a sturdy two-sided flat panel having three openings therein for receiving the two temples and the bridge area of a pair of eyeglasses, said panel having a raised lip around the perimeter of both sides and reinforcing members between said openings on one side; and b. a small durable case in the form of an elongated closable pocket for snugly receiving said panel.

7. The protector described in claim 6 above wherein two of said openings are located at opposite ends of said panel for receiving the two temples of a pair of eyeglasses, and the remaining opening is located near the center of said panel for receiving the bridge and nose clips of a pair of eyeglasses.

8. The protector described in claim 6 above wherein said panel is made of a crush proof material and said case is made of a durable flexible material.

9. The protector described in claim 6 above wherein the panel is made of wood and the case is made of leather.

10. The protector described in claim 6 above wherein said case includes a closable flap.

11. The holder described in claim 1 wherein a carrying means is provided on the outside of said case.

12. The protector described in claim 6 wherein a carrying means is provided on the outside of said case.

* * * * *